US011295686B2

(12) United States Patent
Ono et al.

(10) Patent No.: US 11,295,686 B2
(45) Date of Patent: Apr. 5, 2022

(54) LIQUID CRYSTAL CONTROL CIRCUIT, ELECTRONIC TIMEPIECE, AND LIQUID CRYSTAL CONTROL METHOD

(71) Applicant: CASIO COMPUTER CO., LTD., Tokyo (JP)

(72) Inventors: Takahiro Ono, Akishima (JP); Fumiaki Ochiai, Higashiyamato (JP); Yoshinori Asami, Fussa (JP); Eiji Yamakawa, Tama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/014,730

(22) Filed: Sep. 8, 2020

(65) Prior Publication Data

US 2020/0402474 A1 Dec. 24, 2020

Related U.S. Application Data

(62) Division of application No. 16/358,222, filed on Mar. 19, 2019, now abandoned.

(30) Foreign Application Priority Data

Mar. 22, 2018 (JP) ..... JP2018-054658

(51) Int. Cl.
*G09G 3/36* (2006.01)
*G04G 9/12* (2006.01)

(52) U.S. Cl.
CPC ..... *G09G 3/3614* (2013.01); *G04G 9/12* (2013.01); *G09G 2310/08* (2013.01)

(58) Field of Classification Search
None
See application file for complete search history.

(56) References Cited

U.S. PATENT DOCUMENTS

2001/0043178 A1 11/2001 Okuzono et al.
2010/0118012 A1 5/2010 Irie et al.
(Continued)

FOREIGN PATENT DOCUMENTS

JP 5450784 B2 3/2014
JP 2015-87437 A 5/2015
WO 2013/084813 A1 6/2013

OTHER PUBLICATIONS

Japanese Notice of Reasons for Refusal, dated Jan. 25, 2022, for Japanese Application No. 2018-054658, (with English translation), (6 pages).

*Primary Examiner* — Christopher R Lamb
(74) *Attorney, Agent, or Firm* — Seed IP Law Group LLP

(57) ABSTRACT

A liquid crystal control circuit includes: a first terminal that outputs a rewriting signal for rewriting a plurality of pixels; a second terminal that periodically designates a start timing of the rewriting signal; a third terminal that outputs a polarity signal for designating polarity of AC voltage; a first circuit that identifies a next second inversion timing of any first inversion timing at which the polarity is inverted; a calculator that calculates a first start timing after the first inversion timing based on the start timing; a second circuit that determines whether the second inversion timing is within a period from a predetermined time before the first start timing to the first start timing; and an inversion unit that inverts polarity of the polarity signal after the rewriting signal starting from the first start timing is stopped, when the second inversion timing is within the period.

5 Claims, 8 Drawing Sheets

(56) References Cited

U.S. PATENT DOCUMENTS

| | | | | |
|---|---|---|---|---|
| 2012/0306835 | A1 | 12/2012 | Kitagawa et al. | |
| 2012/0313924 | A1 | 12/2012 | Kitagawa et al. | |
| 2014/0340383 | A1 | 11/2014 | Gyouten et al. | |
| 2018/0240422 | A1* | 8/2018 | Omura | G09G 3/3655 |

* cited by examiner

LIQUID CRYSTAL CONTROL CIRCUIT, ELECTRONIC TIMEPIECE, AND LIQUID CRYSTAL CONTROL METHOD

CROSS-REFERENCE TO RELATED APPLICATION

This application is a Divisional of U.S. patent application Ser. No. 16/358,222 filed Mar. 19, 2019, which is based on and claims priority under 35 USC 119 from Japanese Patent Application No. 2018-054658 filed on Mar. 22, 2018, the contents of which are incorporated herein by reference.

TECHNICAL FIELD

The technical field relates to a liquid crystal control circuit, an electronic timepiece, and a liquid crystal control method.

BACKGROUND

In a liquid crystal panel, reliability of liquid crystals is kept by applying AC voltage to pixels. For example, one electrodes of a plurality of pixels configuring the liquid crystal panel are set as a common electrode, and a potential of the common electrode is inverted. Also, an MIP (Memory In Pixel) liquid crystal includes a memory for each pixel, and inversion of a VCOM signal defining polarity of AC voltage to be applied to the pixel and writing of an image data signal are performed in an asynchronous manner.

When the timings of the VCOM signal and the image data signal are asynchronous, a polarity inverting timing and an output period of the image data overlap, so that the image data may not be normally written. For this reason, a liquid crystal control circuit configured to control the liquid crystal panel is required to have timing control for avoiding confliction between two signals.

For example, according to a liquid crystal display device disclosed in Japanese Patent No. 5,450,784B, when it is determined that a transmission period until an image signal is completely output to a liquid crystal panel is included in a transmission standby period, an image signal is output to the liquid crystal panel after the transmission standby period is over. As used herein the term "transmission standby period" indicates a period including a polarity inversion period and a polarity change time from a reference time at which polarity of AC voltage is inverted.

Also, in general, when controlling the liquid crystals panel by using a microcomputer and the like, a CPU issues a transmission command of image data and a transmission timing thereof is set using a timer circuit. In this case, whenever transmitting data, CPU interrupt processing occurs, so that processing time is prolonged as much as that. Also, while the processing is executed, the CPU is occupied, so that the other processing is temporarily stopped.

However, according to the technology disclosed in Japanese Patent No. 5,450,784B, when the transmission period is included in the transmission standby period, the image signal (image data) is not output to the liquid crystal panel until the transmission standby period is over. Thereby, a frame period of a moving picture to be displayed on the liquid crystal panel becomes disordered, so that movement becomes unnatural.

SUMMARY

In order to solve the above problems, in preferred embodiments, a liquid crystal control circuit connected between a liquid crystal display panel configured to apply AC voltage to a plurality of pixels and a controller (CPU) includes: a rewriting signal output terminal (42, 43) that outputs a rewriting signal (ENBG, ENBS) for rewriting the plurality of pixels to the liquid crystal display panel; a timing input terminal (44) that periodically designates a start timing of the rewriting signal; a polarity signal output terminal (41) that outputs a polarity signal (VCOM) for designating polarity of the AC voltage to the liquid crystal display panel; a time measurement circuit (1) that identifies a next second inversion timing (T2) of any first inversion timing (T1) at which the polarity is inverted; a calculator (4) that calculates a first start timing (T4) after the first inversion timing (T1) based on the start timing; a determination circuit (2) that determines whether the second inversion timing (T2) is within an inversion prohibition period from a predetermined time (T4) before the first start timing (T0) to the first start timing (T0); and an inversion unit (3) that inverts polarity of the polarity signal after the rewriting signal starting from the first start timing (T0) is stopped (T5), when the determination circuit determines that the second inversion timing (T2) is within the inversion prohibition period. The reference numerals and characters in parentheses are just exemplary.

DETAILED DESCRIPTION OF THE PREFERRED EMBODIMENTS

Figure 1:
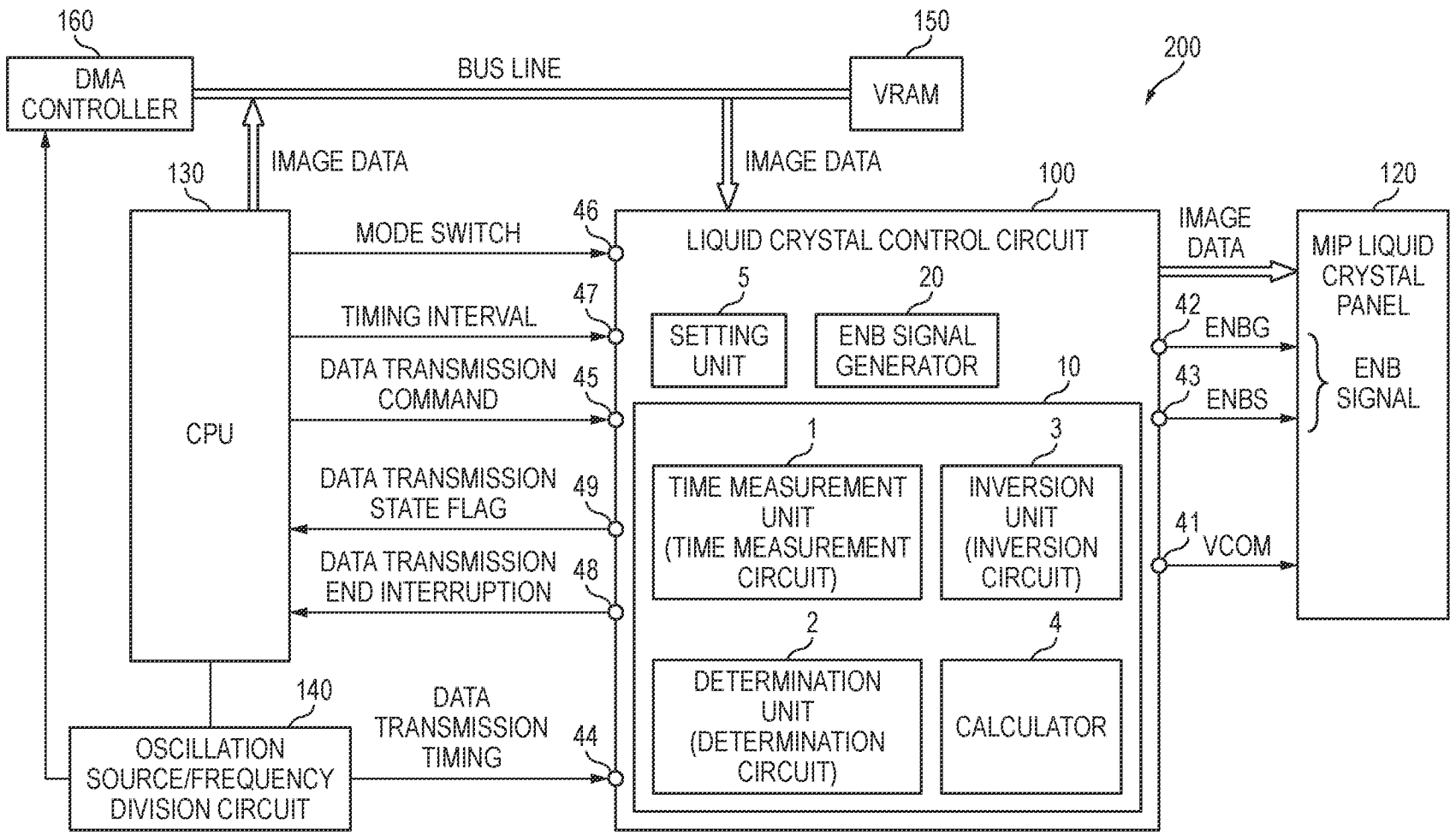
FIG. 1 depicts a configuration of an electronic timepiece including a liquid crystal control circuit of a first illustrative embodiment.

Hereinafter, illustrative embodiments will be described in detail with reference to the drawings. In the meantime, the respective drawings schematically show the illustrative embodiments so as to sufficiently understand the same. Also, in the respective drawings, the common or same constitutional elements are denoted with the same reference numerals, and the overlapping descriptions thereof are omitted.

First Illustrative Embodiment

Figure 2:
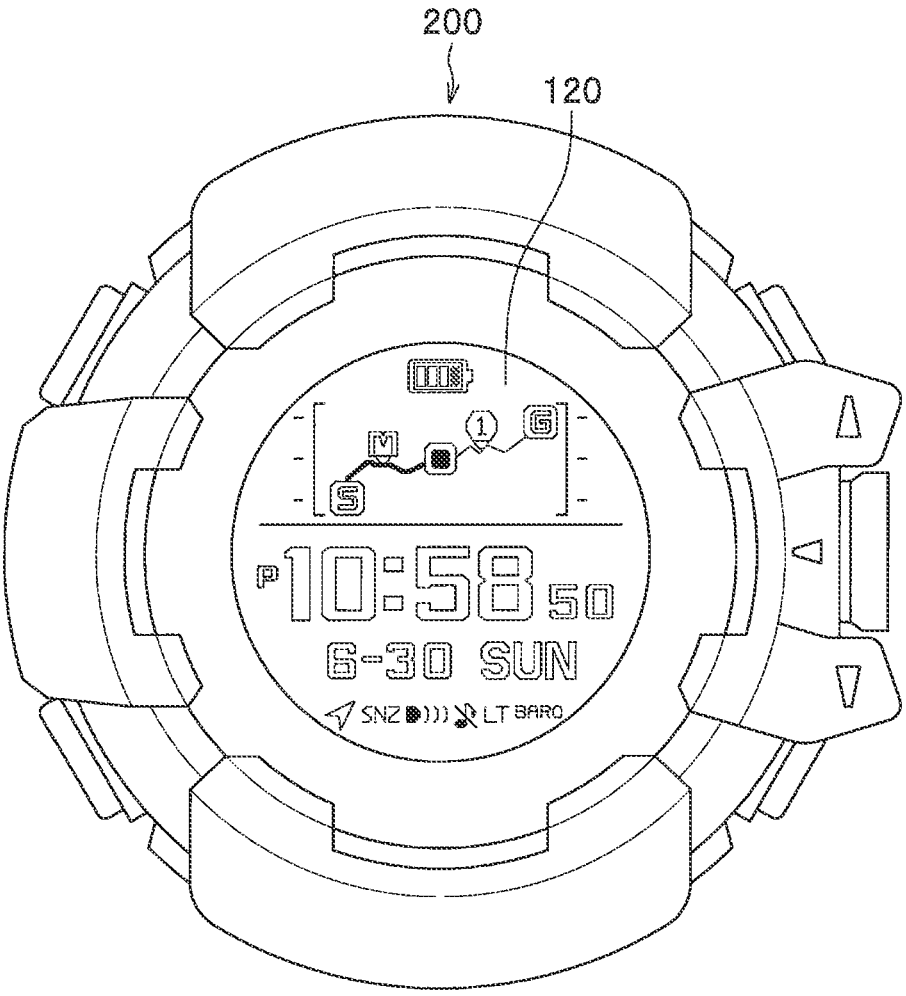
FIG. 2 depicts an outer shape of the electronic timepiece of the first illustrative embodiment.

FIG. 1 depicts a configuration of an electronic timepiece including a liquid crystal control circuit of a first illustrative embodiment, and FIG. 2 depicts an outer shape of the electronic timepiece of the first illustrative embodiment.

An electronic timepiece 200 includes a liquid crystal display device having an MIP (Memory In Pixel) liquid crystal panel 120, a CPU (Central Processing Unit) 130 as a controller, a liquid crystal control circuit 100, an oscillation source/frequency division circuit 140, a VRAM 150, and a DMA (Direct Memory Access) controller 160.

The MIP liquid crystal panel 120 has a plurality of pixels aligned in a two dimensional manner, and is configured to display a still image and a moving picture, as shown in FIG. 2. When a liquid crystal panel is driven by direct current, fine impurities in the liquid crystals become electric charges and are accumulated with leaning to one side, so that the liquid crystal panel is deteriorated. For this reason, the MIP liquid crystal panel 120 is configured to apply AC voltage to the plurality of pixels, thereby suppressing so-called ghosting and the like. Also, the MIP liquid crystal panel 120 includes a memory for storing image data (brightness data) in each of the plurality of pixels, and an inversion timing of a VCOM signal for designating polarity of the AC voltage to be applied to the pixels and a writing timing of the image data signal are asynchronous.

The liquid crystal control circuit 100 is connected between the MIP liquid crystal panel 120 and the CPU 130, and is configured to drive/control the MIP liquid crystal panel 120 under control of the CPU 130.

The liquid crystal control circuit 100 is configured to receive a mode switch signal, a timing interval signal, and a data transmission command from the CPU 130, and to output a data transmission state flag and a data transmission end interruption to the CPU 130. The liquid crystal control circuit 100 is configured to output an ENB (Enable) signal including an ENBG signal and an ENBS signal, a VCOM signal, and image data to the MIP liquid crystal panel 120. To this end, the liquid crystal control circuit 100 has a VCOM output terminal 41 as a polarity signal output terminal, an ENBG terminal 42 and an ENBS terminal 43 as a rewriting signal output terminal, a timing input terminal 44, a data transmission command input terminal 45, a mode switch terminal 46, a timing interval setting terminal 47, a data transmission end interruption terminal 48, and a data transmission state flag terminal 49.

The CPU 130 is configured to generate the image data and to control the respective units. To this end, the CPU 130 is connected to the VRAM 150, the liquid crystal control circuit 100 and the DMA controller 160 by a bus line. The oscillation source/frequency division circuit 140 has a quartz oscillator embedded therein, and is configured to supply clocks to the CPU 130 and to apply a data transmission timing of a predetermined interval set by the CPU 130 to the MIP liquid crystal panel 120 and the DMA controller 160. In the VRAM 150, the image data is stored. An interval of the data transmission timing is about 1 second in a standard mode or about preset 20 msec to 100 msec.

The DMA controller 160 is configured to store the image data generated by the CPU 130 in the VRAM 150, and to transmit the image data stored in the VRAM 150 to the liquid crystal control circuit 100. In the meantime, the image data transmitted to the liquid crystal control circuit 100 is output to the MIP liquid crystal panel 120. Also, a transmission timing of the DMA controller 160 is based on the data transmission timing that is to be output from the oscillation source/frequency division circuit 140.

The liquid crystal control circuit 100 is configured to implement functions of a setting unit 5, a VCOM signal generator 10, and an ENB (Enable) signal generator 20 as a rewriting signal generator by hardware logics.

The setting unit 5 is configured to set any one of a normal mode and a timing fixing transmission mode, based on a mode switch signal from the CPU 130. The normal mode is a mode in which the interval of the data transmission timing is to be fixed to about 1 second. The timing fixing transmission mode is a mode in which the interval of the data transmission timing is to be varied. In a case of the timing fixing transmission mode, the setting unit 5 sets the interval of the data transmission timing within a range of about 20 msec to about 100 msec. For example, when the interval is set to 33 msec, a moving picture of 30 frames/sec can be displayed. Also, the setting unit 5 is configured to set an inversion interval tcVCOM of the VCOM signal.

The VCOM signal generator 10 includes a time measurement unit 1 as a time measurement circuit, a determination unit 2 as a determination circuit, an inversion unit 3 as an inversion circuit, and a calculator 4. The ENB signal generator 20 is configured to output the ENB signal (ENBG signal, ENBS signal) as a rewriting signal, based on the image data.

Figure 3:
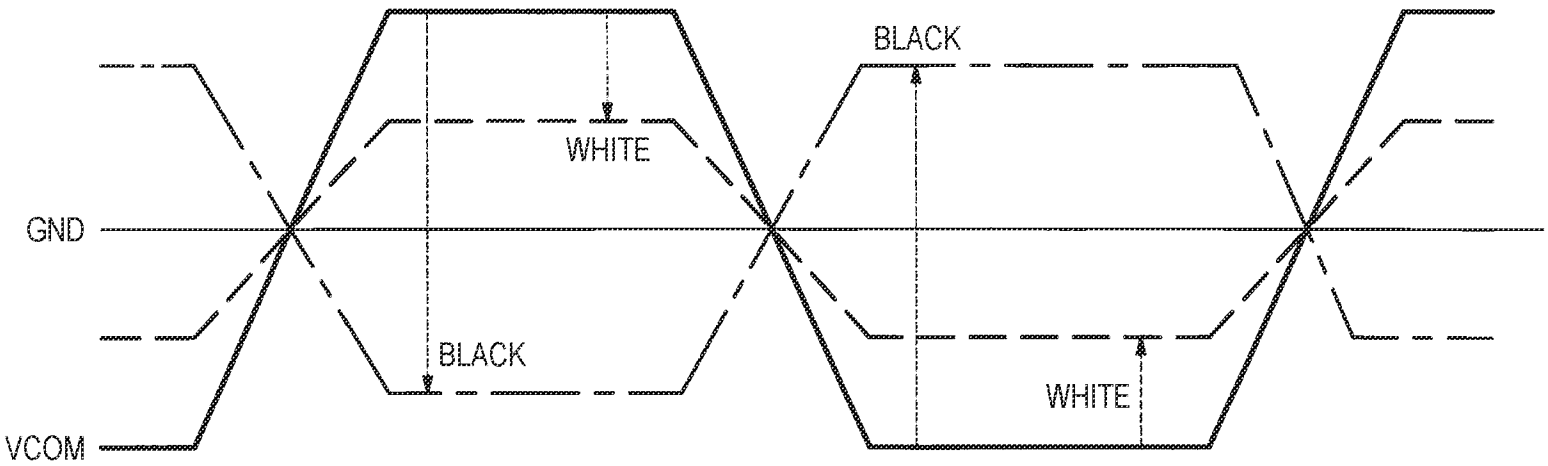
FIG. 3 is a timing chart for illustrating a VCOM signal of the liquid crystal control circuit of the first illustrative embodiment.

FIG. 3 is a timing chart for illustrating the VCOM signal of the liquid crystal control circuit of the first illustrative embodiment.

As described above, in the MIP liquid crystal panel 120, one electrodes of the plurality of pixels are set to a common electrode, and AC voltage is applied to the plurality of pixels. FIG. 3 depicts a potential (VCOM) (thick solid line) of a common terminal of liquid crystals, white level electronic potential (broken line) of a non-common terminal and black level electronic potential (dashed-dotted line) of the non-common terminal on the basis of a GND level of the MIP liquid crystal panel 120. In the meantime, a down-arrow from the electronic potential (VCOM) of the common terminal indicates negative applying voltage, and an up-arrow indicates positive applying voltage.

That is, the MIP liquid crystal panel 120 is configured to apply the AC voltage to the pixels while inverting the electronic potential of the common terminal and the electronic potential of the non-common electrode with respect to the GND electronic potential. The VCOM signal (FIG. 1) is a signal for designating polarity of the AC voltage to be applied to the liquid crystals. In the meantime, an electronic potential difference of the black level is larger than an electronic potential difference of the white level.

Figure 4:
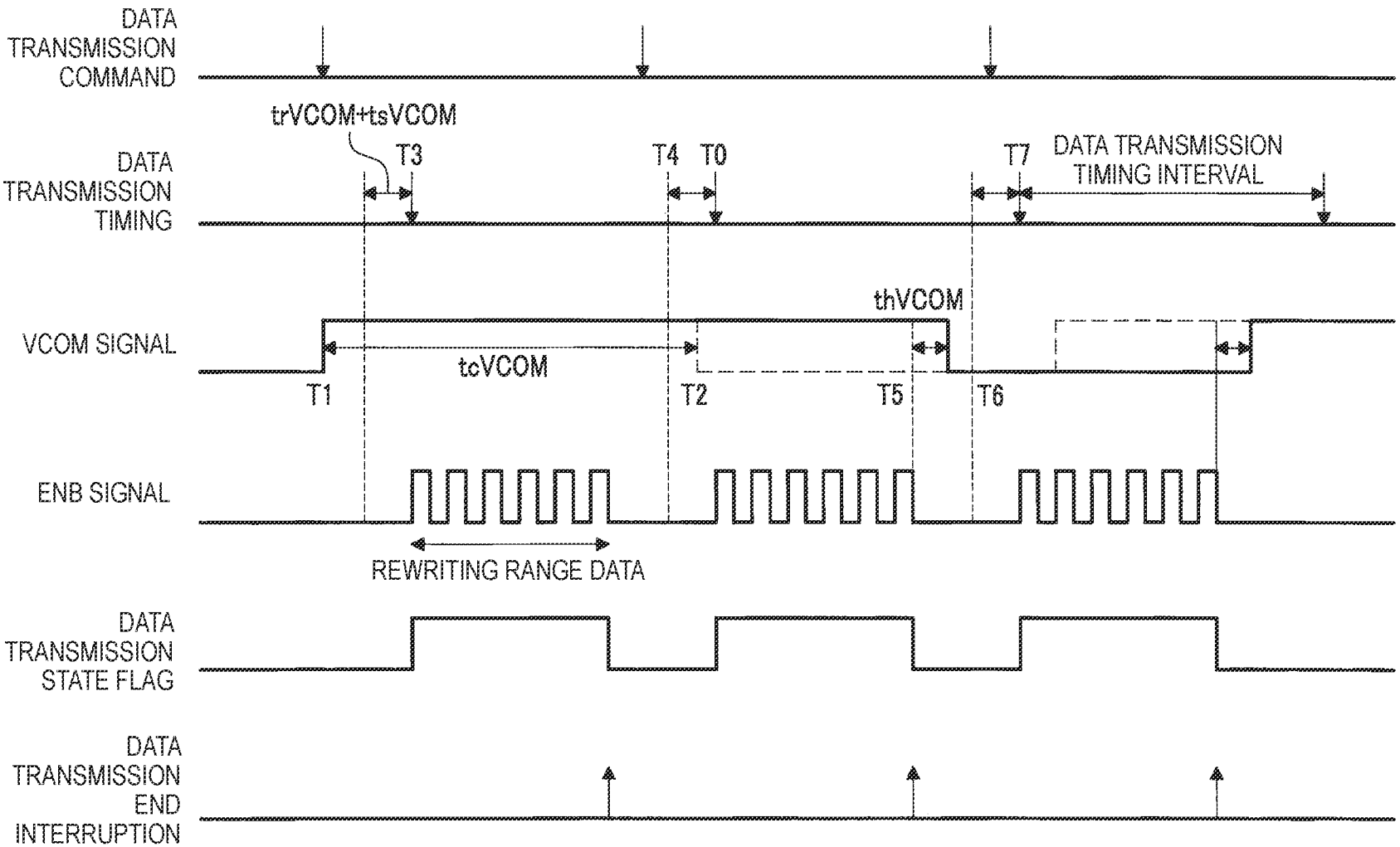
FIG. 4 is a timing chart of the liquid crystal control circuit of the first illustrative embodiment.

FIG. 4 is a timing chart for illustrating the VCOM signal of the liquid crystal control circuit of the first illustrative embodiment. In FIG. 4, the data transmission command, the data transmission timing, the VCOM signal, the ENB signal, the data transmission state flag, and the data transmission interruption are shown from above.

The time measurement unit 1 is a time measurement circuit configured to measure a time to a next inversion timing (a second inversion timing T2) on the basis of any inversion timing (a first inversion timing T1) of the VCOM signal. That is, the time measurement unit 1 identifies the second inversion timing T2 having elapsed from the first inversion timing T1 by an inversion interval tcVCOM.

Also, the calculator 4 calculates a first start timing T0 after the first inversion timing T1, based on a row of the data transmission timings. That is, the calculator 4 calculates a time to a next data transmission timing T3 of the first inversion timing T1, and calculates a first start timing T0 to which a data transmission timing interval has been added, based on the data transmission timing T3. The data transmission timing interval can be calculated at a PLL (Phase Locked Loop) or the like provided in the liquid crystal control circuit 100 by using the row of the data transmission timings periodically received, for example.

The determination unit 2 is a determination circuit that determines whether the second inversion timing T2 measured by the time measurement unit 1 is within an inversion prohibition period from a predetermined time T4 before the first start timing T0 of the data transmission timing to the first start timing T0. Here, the predetermined time is a sum of a polarity change time trVCOM and a polarity inversion period tsVCOM prescribed in accordance with characteristics of the liquid crystals. When it is determined that the second inversion timing T2 is not within the inversion prohibition period, the inversion unit 3 inverts the VCOM signal at the second inversion timing T2, as shown with the broken line. Here, when it is determined that the second inversion timing T2 is within the inversion prohibition period, the inversion unit 3 does not invert the VCOM signal at the second inversion timing T2, and inverts the VCOM signal after a predetermined time (thVCOM) elapses (T6) from end (T5) of the ENB signal, as shown with the solid line.

The ENB signal generator 20 starts to output the ENB signal at the data transmission timing T3, T0, T7 . . . . Also, the ENB signal generator 20 sets the data transmission state flag to a high level during the output of the ENB signal and generates a data transmission end interruption upon ending of the ENB signal.

As described above, the liquid crystal control circuit 100 of the first illustrative embodiment does not invert the VCOM signal when the second inversion timing T2 is within the inversion prohibition period. As used herein the term "inversion prohibition period" is intended to mean a period from the predetermined time T4 before the first start timing T0 to the first start timing T0. That is, since the VCOM signal is not inverted, it is possible to output the ENB signal for rewriting the image data. When the rewriting of the image data is over and the output of the ENB signal is stopped (T5), the inversion unit 3 stands by for the predetermined time (thVCOM) and then inverts the VCOM signal at time T6. That is, the inversion unit 3 stands by for the output period of the ENB signal and the periods (trVCOM +tsVCOM, thVCOM) before and after the output period for the VCOM signal.

Thereby, it is possible to avoid confliction between the data transmission and the inversion timing of the VCOM signal. Also, when it is intended to transmit data at a constant period, the CPU 130 may output a data transmission command at any timing within the data transmission timing interval without performing counting by the timer circuit or interruption by the CPU 130. Also, the data transmission command to be output by the CPU 130 is not limited to a head of data transmission and may be output at any timing.

Second Illustrative Embodiment

According to the liquid crystal control circuit 100 of the first illustrative embodiment, there is the image data and the ENB signal is output at the first start timing T0 of the data transmission timing. However, there may be no image data at the first start timing T0. In the below, an example where there is no image data at the first start timing T0 is described. A configuration of the electronic timepiece 200 of a second illustrative embodiment is the same as the configuration of the electronic timepiece 200 of the first illustrative embodiment.

Figure 5:
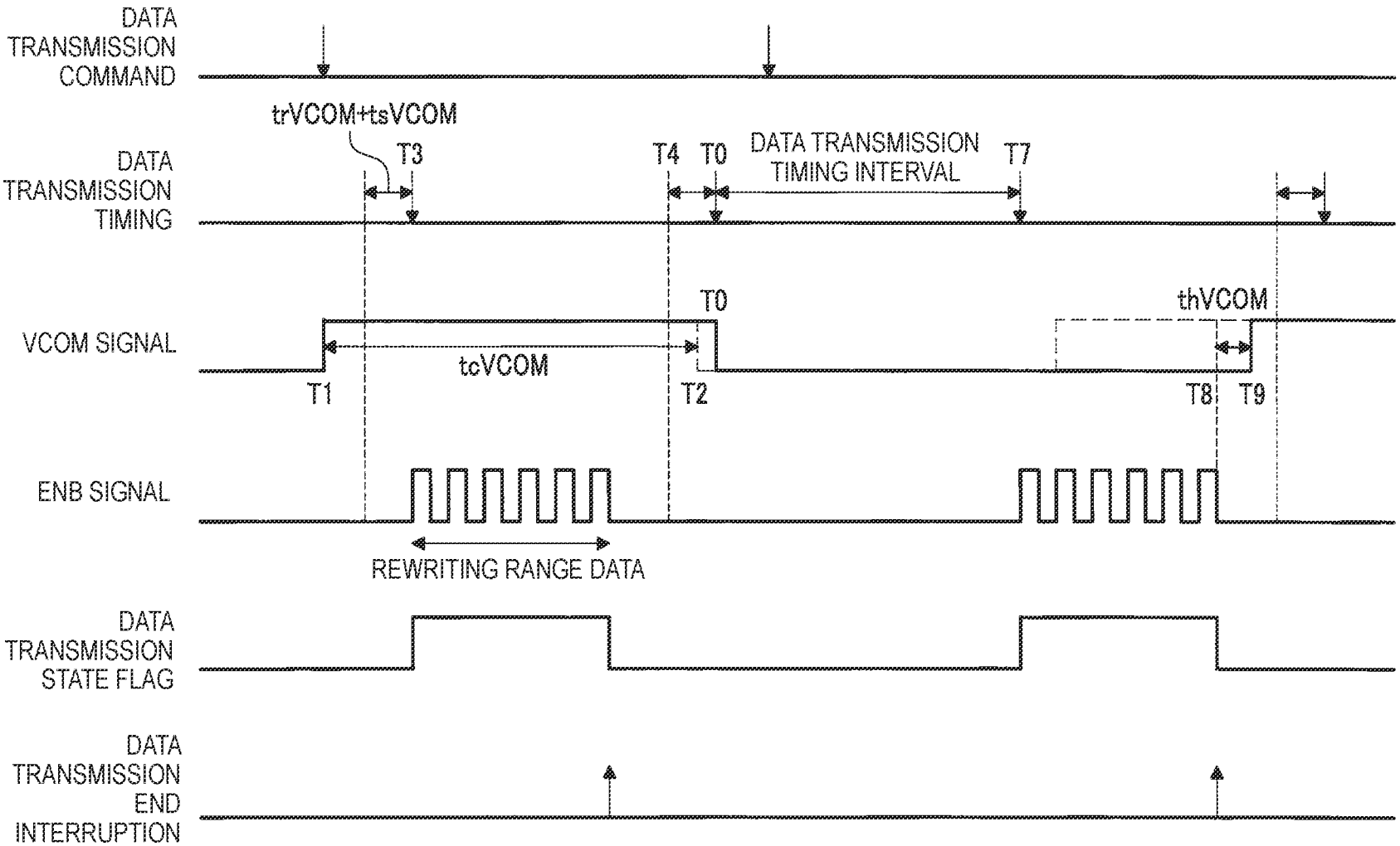
FIG. 5 is a timing chart of a liquid crystal control circuit of a second illustrative embodiment.

FIG. 5 is a timing chart of the liquid crystal control circuit of the second illustrative embodiment.

The operations of the time measurement unit 1 and the determination unit 2 are the same as in the first illustrative embodiment.

When it is determined that the second inversion timing T2 is not within the inversion prohibition period from T4 to T0, the inversion unit 3 inverts the VCOM signal at the second inversion timing T2, as shown with the broken line. On the other hand, when it is determined that the second inversion timing T2 is within the inversion prohibition period, the inversion unit 3 inverts the VCOM signal at the first start timing T0, as shown with the solid line. That is, since the liquid crystal control circuit 100 cannot determine whether or not the image data until the first start timing T0, the inversion unit 3 does not invert the VCOM signal at the second inversion timing T2 and inverts the VCOM signal at the first start timing T0.

In the meantime, at a next data transmission timing (second start timing T7) of the first start timing T0, the ENB signal generator 20 starts to output the ENB signal. Accompanied by the output of the ENB signal, the ENB signal generator 20 sets the data transmission state flag to a high level. Then, when the output of the ENB signal is stopped, the inversion unit 3 inverts the VCOM signal after the predetermined time (thVCOM) elapses (T9) from ending (T8) of the ENB signal. Then, accompanied by the stop of the ENB signal, the ENB signal generator 20 sets the data transmission state flag to a low level, and generates a data transmission end interruption.

According to the liquid crystal control circuit 100 of the second illustrative embodiment, for the inversion prohibition period, the inversion unit 3 inverts the VCOM signal at the first start timing T0. As used herein the term "inversion prohibition period" is intended to mean the second inversion timing T2 ranging from the predetermined time T4 before the first start timing T0 to the first start timing T0. Then, the ENB signal generator 20 starts to output the ENB signal at a next data transmission timing (second start timing T7) of the first start timing T0. When there is no rewriting of the image data and the output of the ENB signal is stopped (T8), the inversion unit 3 stands by for the predetermined time (thVCOM) and then inverts again the VCOM signal at time T9.

Third Illustrative Embodiment

The liquid crystal control circuit 100 (100*a*) of the first and second illustrative embodiments implements the functions of the setting unit 5, the VCOM signal generator 10 and the ENB (Enable) signal generator 20 by the hardware logics. In a liquid crystal control circuit 100 (100*b*) of a third illustrative embodiment, a CPU (controller) different from the CPU 130 is configured to execute a program to implement the respective functions. That is, the other CPU is configured to execute a program to implement all or some of the functions of the setting unit 5, the VCOM signal generator 10 and the ENB signal generator 20. Also, the other CPU has an inversion prohibition period flag indicative of the inversion prohibition period from T4 to T0. In the meantime, the other CPU uses a liquid crystal control method by execution of the program.

Figure 6:
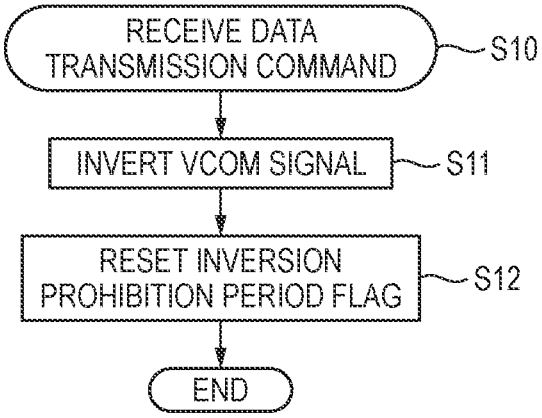
FIG. 6 is a flowchart (1) for illustrating operations of a liquid crystal control circuit of a third illustrative embodiment.

FIG. 6 is a flowchart (1) for illustrating operations of the liquid crystal control circuit of the third illustrative embodiment. A routine S10 corresponds to an input of power supply or a reset, and interrupt activation is performed upon first receiving of the data transmission command (T1).

The VCOM signal generator 10 inverts the VCOM signal upon first receiving of the data transmission command (T1) (S11). After the processing of S11, the VCOM signal generator 10 resets the inversion prohibition period flag (S12), and ends the processing.

Figure 7:
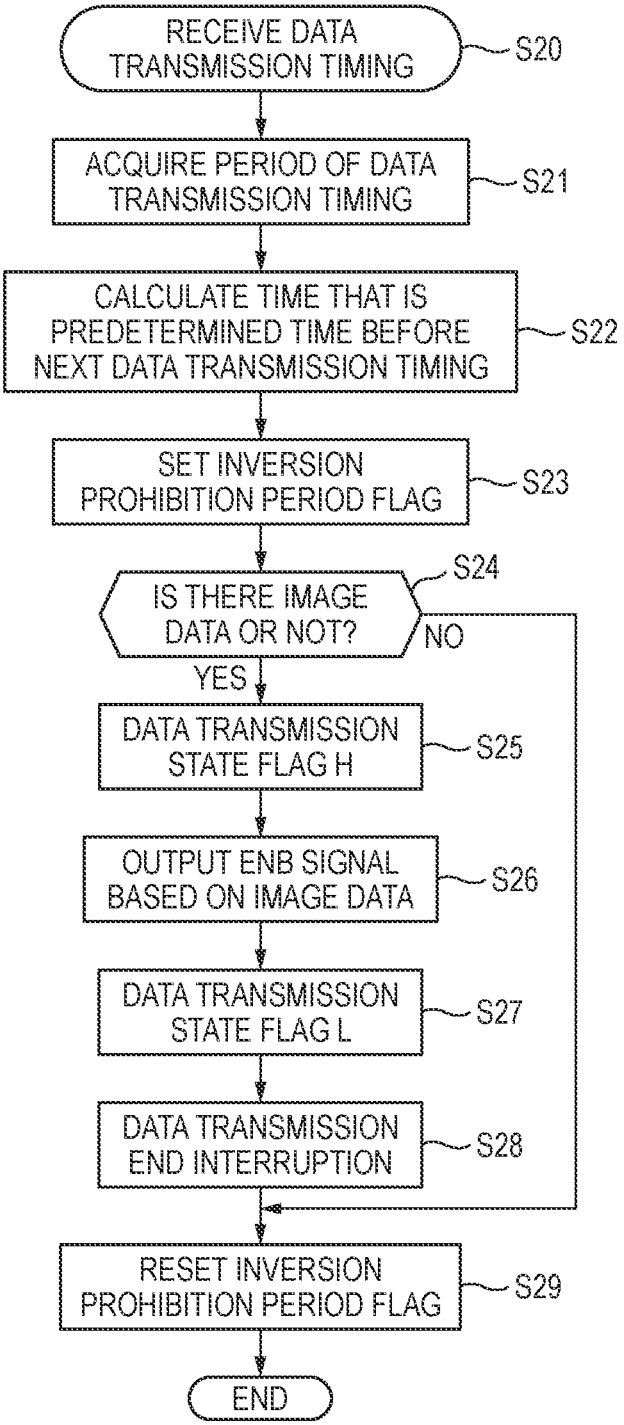
FIG. 7 is a flowchart (2) for illustrating operations of the liquid crystal control circuit of the third illustrative embodiment.

FIG. 7 is a flowchart (2) for illustrating operations of the liquid crystal control circuit of the third illustrative embodiment. In this routine S20, interrupt activation is sequentially performed when the data transmission timings T3, T0, T7, . . . (FIGS. 4 and 5) output by the oscillation source/frequency division circuit 140 are received.

The ENB signal generator 20 acquires a period of the data transmission timing (data transmission timing interval) (S21). For example, the ENB signal generator 20 may acquire a parameter, which is set to the oscillation source/frequency division circuit 140 by the CPU 130, or measure a data transmission timing interval from any data transmission timing T3 to a next data transmission timing (first start timing T0).

After the processing of S21, the ENB signal generator 20 calculates a time that is the predetermined time T4 before the next data transmission timing (first start timing T0) (S22), and sets the inversion prohibition period flag (S23).

After the processing of S23, the ENB signal generator 20 determines whether or not there is the image data (S24). When there is the image data (Yes in S24), the ENB signal generator 20 sets the data transmission state flag to a High level (S25), and outputs the ENB signal on the basis of the image data (S26). After the processing of S26, the ENB signal generator 20 sets the data transmission state flag to a Low level (S27), generates a data transmission end interruption (S28), and releases the setting of the inversion prohibition period flag (S29). On the other hand, when it is determined in S24 that there is no image data (No in S24), the ENB signal generator 20 releases the setting of the inversion prohibition period flag (S29).

Figure 8:
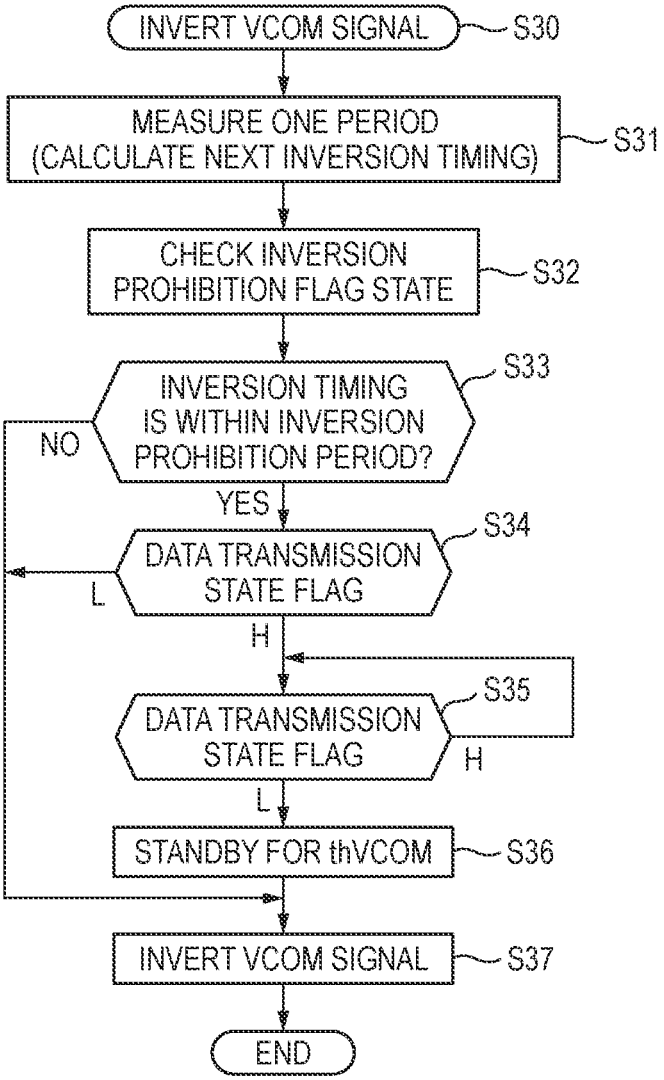
FIG. 8 is a flowchart (3) for illustrating operations of the liquid crystal control circuit of the third illustrative embodiment.

FIG. 8 is a flowchart (3) for illustrating operations of the liquid crystal control circuit of the third illustrative embodiment. In this routine S30, when the VCOM signal is inverted (for example, T1), interrupt activation is performed.

The VCOM signal generator 10 measures the inversion interval (tcVCOM) and acquires a next inversion timing (second inversion timing T2) (S31). After the processing of S31, the VCOM signal generator 10 checks a state of the inversion prohibition flag set in S23 (S32), and determines whether the second inversion timing T2 acquired in S31 is within the inversion prohibition period (S33).

When it is determined that the second inversion timing T2 is within the inversion prohibition period (Yes in S33), the VCOM signal generator 10 determines a state of the data transmission state flag (S34). When it is determined that the data transmission state flag is a High level (H in S34), the VCOM signal generator 10 stands by until the data transmission state flag becomes a Low level (S35). When the data transmission state flag becomes a Low level (L in S35, T5), the VCOM signal generator 10 stands by for the predetermined time thVCOM (S36), and inverts the VCOM signal (S37, T6).

On the other hand, when it is determined that the second inversion timing T2 is not within the inversion prohibition period (No in S33) or the data transmission state flag is a Low level (L in S34), the VCOM signal generator 10 inverts the VCOM signal at the data transmission timing (first start timing T0) (S37), and ends the processing.

As described above, according to the third illustrative embodiment, it is possible to implement the liquid crystal control circuit by the minimum hardware logic. Also, when the functions of the CPU 130 are introduced in the liquid crystal control circuit, the liquid crystal control circuit can be implemented by the single CPU.

What is claimed is:

1. A liquid crystal control circuit connected to a liquid crystal display panel including a memory for storing image data in each of a plurality of pixels, the liquid crystal control circuit comprising:

a switching unit configured to switch polarity of voltage applied to a common electrode in the liquid crystal display panel at a predetermined timing;

a first determination unit configured to determine whether a timing of switching the polarity by the switching unit is between a start timing of image data transmission to the memory and a predetermined time before the start timing of image data transmission; and a second determination unit configured to determine whether there is image data to be transmitted at the start timing of image data transmission, wherein, in response to the first determination unit determining that the timing of switching the polarity is between the start timing of image data transmission and the predetermined time before the start timing of image data transmission and the second determination unit determining that there is image data to be transmitted at the start timing of image data transmission, the switching unit switches the polarity after the image data has been transmitted, and, in response to the first determination unit determining that the timing of switching the polarity is between the start timing of image data transmission and the predetermined time before the start timing of image data transmission and the second determination unit determining that there is no image data to be transmitted at the start timing of image data transmission, the switching unit switches the polarity based on the start timing of image data transmission.

2. The liquid crystal control circuit according to claim 1, wherein the predetermined time is a sum of a polarity change time and a polarity inversion time that are prescribed in accordance with characteristics of liquid crystal of the liquid crystal display panel.

3. The liquid crystal control circuit according to claim 1, wherein, in response to the first determination unit determining that the timing of switching the polarity is not between the start timing of image data transmission and the predetermined time before the start timing of image data transmission, the switching unit switches the polarity before the start timing of image data transmission.

4. A liquid crystal control method executed by a liquid crystal control circuit connected to a liquid crystal display panel including a memory for storing image data in each of a plurality of pixels, the liquid crystal control method comprising:

determining whether a timing of switching polarity of voltage applied to a common electrode in the liquid crystal display panel is between a start timing of image data transmission to the memory and a predetermined time before the start timing of image data transmission; and determining whether there is image data to be transmitted at the start timing of image data transmission;

in response to determining that the timing of switching the polarity is between the start timing of image data transmission and the predetermined time before the start timing of image data transmission and determining that there is image data to be transmitted at the start timing of image data transmission, switching the polarity after the image data has been transmitted; and in response to determining that the timing of switching the polarity is between the start timing of image data transmission and the predetermined time before the start timing of image data transmission and determining that there is no image data to be transmitted at the start timing of image data transmission, switching the polarity based on the start timing of image data transmission.

5. A non-transitory computer-readable storage medium storing a program for causing a processor of a liquid crystal control circuit, which is connected to a liquid crystal display panel including a memory for storing image data in each of a plurality of pixels, to execute a process, the process comprising:

switching processing in which polarity of voltage applied to a common electrode in the liquid crystal display panel is switched at a predetermined timing;

first determination processing in which it is determined whether a timing of switching the polarity in the switching processing is between a start timing of image data transmission to the memory and a predetermined time before the start timing of image data transmission; and second determination processing in which it is determined whether there is image data to be transmitted at the start timing of image data transmission, wherein, in response to determining in the first determination processing that the timing of switching the polarity is between the start timing of image data transmission and the predetermined time before the start timing of image data transmission and determining in the second determination processing that there is image data to be transmitted at the start timing of image data transmission, the polarity is switched, in the switching processing, after the image data has been transmitted, and, in response to determining in the first determination processing that the timing of switching the polarity is between the start timing of image data transmission and the predetermined time before the start timing of image data transmission and determining in the second determination step that there is no image data to be transmitted at the start timing of image data transmission, the polarity is switched, in the switching processing, based on the start timing of image data transmission.

* * * * *